US008091543B2

(12) United States Patent
Baumann et al.

(10) Patent No.: US 8,091,543 B2
(45) Date of Patent: Jan. 10, 2012

(54) COOKING OVEN WITH ANTI-CONDENSATION DOOR

(75) Inventors: Udo Baumann, Hamburg (DE); Dragan Raus, Porcia (IT)

(73) Assignee: Electrolux Professionals S.p.A., Pordenone (IT)

( * ) Notice: Subject to any disclaimer, the term of this patent is extended or adjusted under 35 U.S.C. 154(b) by 0 days.

(21) Appl. No.: 11/757,480

(22) Filed: Jun. 4, 2007

(65) Prior Publication Data

US 2008/0029078 A1 Feb. 7, 2008

(30) Foreign Application Priority Data

Aug. 4, 2006 (IT) ..... PN2006A0059

(51) Int. Cl.
*F23M 7/00* (2006.01)
*F24C 15/04* (2006.01)

(52) U.S. Cl. ..... 126/200; 126/190; 99/341

(58) Field of Classification Search ..... 126/200, 126/190, 194; 99/341
See application file for complete search history.

(56) References Cited

U.S. PATENT DOCUMENTS

| | | | | | |
|---|---|---|---|---|---|
| 3,911,245 | A | * | 10/1975 | O'Shaughnessy | 219/218 |
| 4,035,608 | A | * | 7/1977 | Stromquist et al. | 219/218 |
| 4,248,015 | A | * | 2/1981 | Stromquist et al. | 49/70 |
| 4,306,140 | A | * | 12/1981 | Stromquist | 219/522 |
| 5,258,595 | A | * | 11/1993 | Tanaka | 219/724 |
| 5,447,145 | A | * | 9/1995 | Cappello et al. | 126/20 |
| 5,732,614 | A | * | 3/1998 | Oslin | 99/341 |
| 5,852,284 | A | * | 12/1998 | Teder et al. | 219/522 |
| 5,960,785 | A | | 10/1999 | Byrne et al. | |
| 6,051,820 | A | * | 4/2000 | Poix et al. | 219/522 |
| 6,492,619 | B1 | * | 12/2002 | Sol | 219/203 |
| 6,570,135 | B2 | * | 5/2003 | Gros et al. | 219/396 |
| 7,297,902 | B2 | * | 11/2007 | Weiss | 219/203 |
| 2002/0079306 | A1 | | 6/2002 | Gros et al. | |
| 2004/0222724 | A1 | * | 11/2004 | Cording | 312/405 |
| 2006/0265979 | A1 | * | 11/2006 | Cording | 52/204.5 |
| 2007/0275253 | A1 | * | 11/2007 | Thiel et al. | 428/432 |
| 2007/0285819 | A1 | * | 12/2007 | Gerhardinger | 360/48 |

FOREIGN PATENT DOCUMENTS

| | | |
|---|---|---|
| EP | 1293726 | 3/2003 |
| FR | 2700622 | 7/1994 |
| FR | 2817019 | 5/2002 |
| WO | 9425802 | 11/1994 |

OTHER PUBLICATIONS

European Search Report for EP07111947, dated Jun. 19, 2009, 2 pages.

* cited by examiner

*Primary Examiner* — Kenneth Bomberg
*Assistant Examiner* — Daniel Bernstein
(74) *Attorney, Agent, or Firm* — Pearne & Gordon LLP

(57) ABSTRACT

The present invention generally relates to a cooking oven, which is provided with a cooking cavity and a door adapted to close the cooking cavity. The door is provided with an outer frame and one or more glass panes supported by such frame along the periphery thereof. On the surface of at least one of the glass panes there are applied heating means, which include a layer of substantially clear, e.g. transparent resistive material, and means adapted to connect two sides of such layer of resistive material to appropriate terminals energizable by an electric voltage supplied from a source available inside the oven.

15 Claims, 5 Drawing Sheets

COOKING OVEN WITH ANTI-CONDENSATION DOOR

BACKGROUND OF THE INVENTION

1. Field of Invention

The present invention refers to an improved kind of oven for cooking food, comprising a door—as generally known as such in the art—for gaining access into and closing the cooking cavity of such oven, this door being provided with at least a clear, see-through window adapted to allow the interior of the cooking cavity of the oven to be watched, i.e. inspected during the cooking process.

2. Desription of Related Art

According to the prior art, these kinds of windows are made up by two or more glass panes of a special type, which are disposed in a parallel arrangement relative to each other and are kept firmly in place relative to each other by means of a common peripheral support frame, which acts as the actual window casing or framework, and which is provided—on a vertical side thereof—with hinges adapted to engage appropriate pins provided on a vertical edge on the outside of the cooking cavity of the oven.

The volume that is comprised, i.e. the gap existing between said two glass panes and enclosed by said peripheral frame forms a sealed intermediate chamber therebetween, the purpose of which lies in thermally insulating the inner cooking cavity of the oven from the outside ambient, so that the temperature of the outer surface of the outer glass pane of the door window—i.e. the surface that is directly accessible by an operator—is not able to reach any such high value as to impair the safety in using the oven. In this connection, it should further be noticed that the internationally applying standards regulating the construction of these ovens require that such outer temperatures shall never be able to exceed definite highest allowable values.

While reference is made throughout the following description to a food cooking oven specifically intended for use in professional kitchens, such as in particular mass-catering foodservice applications, in which the inner temperature in the cooking cavity may reach up to particularly high values, it will nevertheless be appreciated that what is being explained, illustrated and generally set forth in the same specification may be understood as equally applying to—and thus used in—food cooking ovens and similar appliances as typically intended for home, i.e. household use.

During a cooking process, owing to the really considerable temperature differences that come to exist between the outside ambient, which lies generally at ambient temperature, and the temperature prevailing inside the afore-cited sealed chamber formed between the window panes of the oven door, a moisture or condensate film—i.e. a so-called mist—can be most frequently noticed to form on the inner surface of the outer glass pane. Such circumstance is largely known to be disadvantageous in that it practically prevents the food in the cooking cavity, and thus the cooking state and/or degree thereof, from being properly observed by the operator who has to survey the progress of the cooking process from outside. Under the circumstances, therefore, for the state of the food being cooked to be able to be visually inspected as required, the operator should first of all open the oven door. However, opening the oven door as a cooking process is going on is largely known to imply a whole set of other rather serious drawbacks, which, owing to them being largely known in the art, actually, shall not be reminded here.

In an effort to eliminate such condensate film, or mist, forming inside the oven door window, the solution has therefore been largely adopted up to now consisting in allowing or, better, causing a stream of air taken in from outside—and which is therefore relatively much less humid and certainly cooler than the air existing inside the chamber between the glass panes of the door window—to flow through the same chamber.

This solution has in practice been found to be generally most effective in solving the basic problem; however, it can readily be appreciated to be connected with definite counterweighing drawbacks in terms of increased construction costs and complexity, owing to appropriate means and devices having or course to be specially provided for such air stream to be able to be generated, be blown into and through said chamber, and be eventually caused to exit it and be exhausted outside.

In view of doing away with such drawbacks, the practice is known—e.g. from the disclosure in DE 299 22 756 U1—of providing a food cooking oven with a door equipped with a glass pane on which there are arranged heating means, particularly in the form of electric wires.

The basic purpose of such electric wires consists in heating up the region in which the glass pane lies, so as to improve the temperature of the zone of the oven cooking cavity lying contiguous to said pane, thereby also obtaining the additional, auxiliary result of improving the visibility of the cooking cavity interior from outside, since said heating means are effective in causing the moisture film that may condense on the inner surface of said pane to evaporate.

This solution, however, turns out as being rather tricky and delicate owing basically to the fact that there certainly is a great number of electric wires to be connected and that, therefore, the periodical cleaning, which the inner surface of the glass pane has necessarily to undergo, may affect the efficiency thereof. Furthermore, this solution is certainly such as to affect the overall outlook, i.e. aesthetics of the product. Finally, it has also to be noticed that, under extreme conditions of temperature and moisture, the desired removal of the condensate layer from the glass pane is hardly obtainable unless the electric wires are arranged very close to each other in a thick pattern, i.e. a condition that would further deteriorate both the internal visibility and the overall outlook of the oven.

The just described solution has been the subject of a prior disclosure in the publication DE-GM 8716665.8, actually. Although the claimed purpose of such utility model lies solely in eliminating the condensate layer, or film, from the inner surface of a glass pane inserted in the door closing the cooking cavity of an oven, the kind of solution taught in said publication is however the same, so that the same considerations as set forth above equally apply in this case, no need arising therefore for them to be indicated and explained again.

BRIEF SUMMARY OF THE INVENTION

It would therefore be desirable, and it is actually a main purpose of the present invention, to provide an oven for food cooking applications, which is provided with a door equipped with a double wall of glass panes, as well as with means adapted to eliminate the condensate film that settles upon the inner surface of the outer glass pane, without this implying the use of a net of electric wires to heat up such surface, while ensuring a full extent of clearness, i.e. transparency of the outer glass pane itself.

According to the present invention, these aims, along with further ones that will become apparent from the following disclosure, are reached in a kind of cooking oven, as particularly intended for foodservice and mass-catering applications, that incorporates the features and characteristics as defined and recited in the appended claims.

BRIEF DESRIPTION OF THE DRAWING

Advantages and features of the present invention will anyway be more readily understood from the description that is given below by way of non-limiting example. with reference to the accompanying drawings, in which.

DETAILED DESRIPTION OF THE INVENTION

Figure 1:
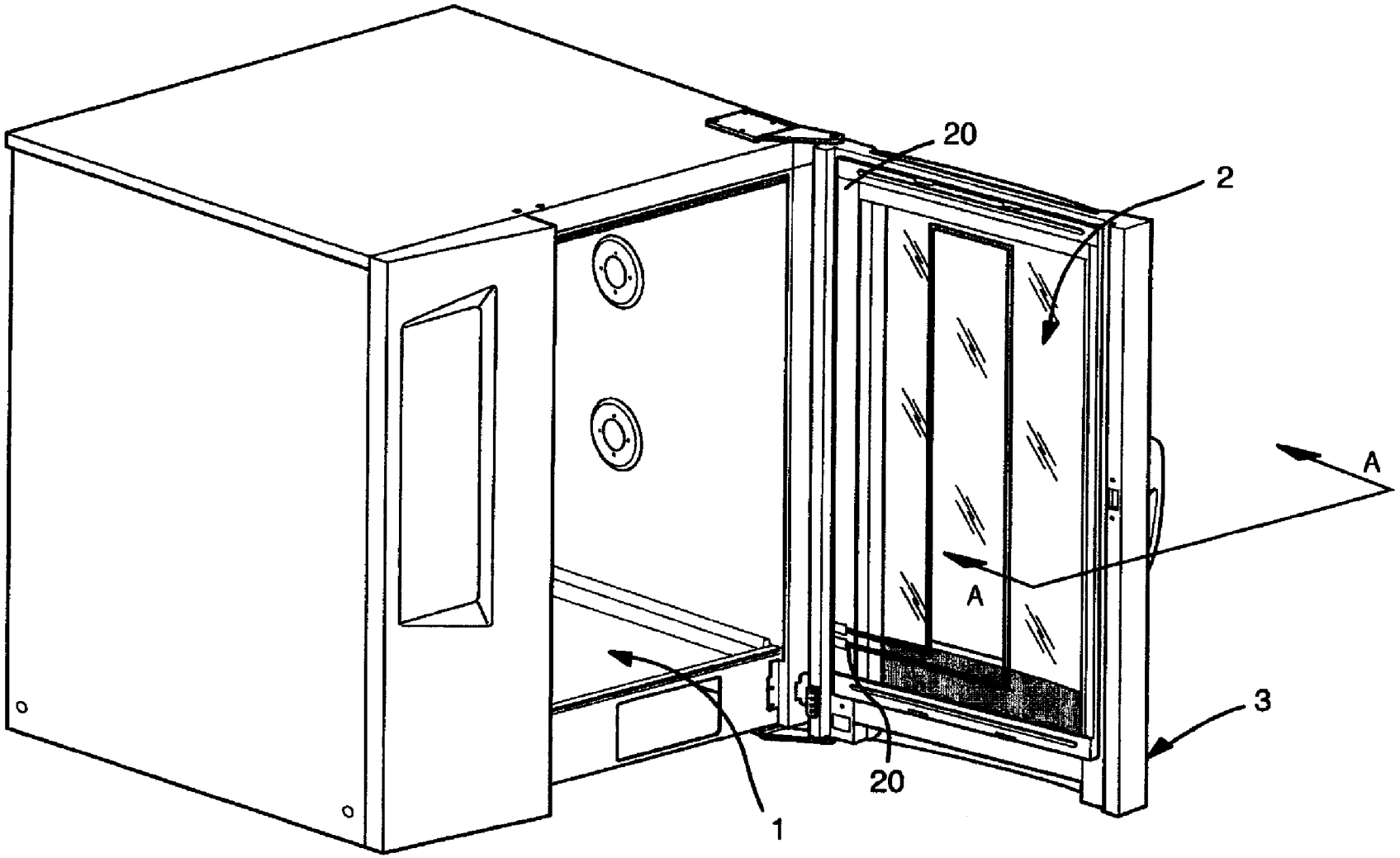
FIG. 1 is a perspective view of a cooking oven according to the present invention, in the state in which its door is opened and viewed from the inside thereof.

With reference to the above-noted Figures, an oven according to the prior art comprises:

a cooking cavity 1, a door 2 adapted to close the cooking cavity and comprised of an outer frame 3 that retains, with its inner perimeter portion, two glass panes, i.e. an inner and an outer pane 4 and 5, respectively, provided in a mutually opposing arrangement parallel to each other, so that between said peripherally retaining frame 3 and said two glass panes there is defined a thermally insulating hollow space or gap 7.

According to the present invention, on the surface 6 of the inner glass pane 4 facing into said hollow space 7 there is applied a layer of resistive material 8. Such layer of resistive material may be formed of any material or compound that combines good processability with an appropriate capability of being applied in the form of a layer, jointly of course to an appropriate resistance to high temperatures and a marked long-term stability.

Furthermore, the above-mentioned resistive material shall be capable of being applied to form very thin layers, e.g. layer having a thickness in the order of just a few microns, so that the glass pane on which it is applied remains substantially clear and transparent or—at most—undergoes just a very slight variation in its transparency.

This layer of resistive material shall be connected to a power supply source, so that during the operation of the oven, i.e. when the high temperature reached in the cooking cavity of the oven causes a condensate film to deposit and form on the inner surface 9 of the outer glass pane 5, such power supply from said source to said layer 8 causes the latter to heat up to a sensible extent, so that also the air contained in the hollow space 7 is heated up to in turn cause said condensate film to evaporate.

Figure 4:
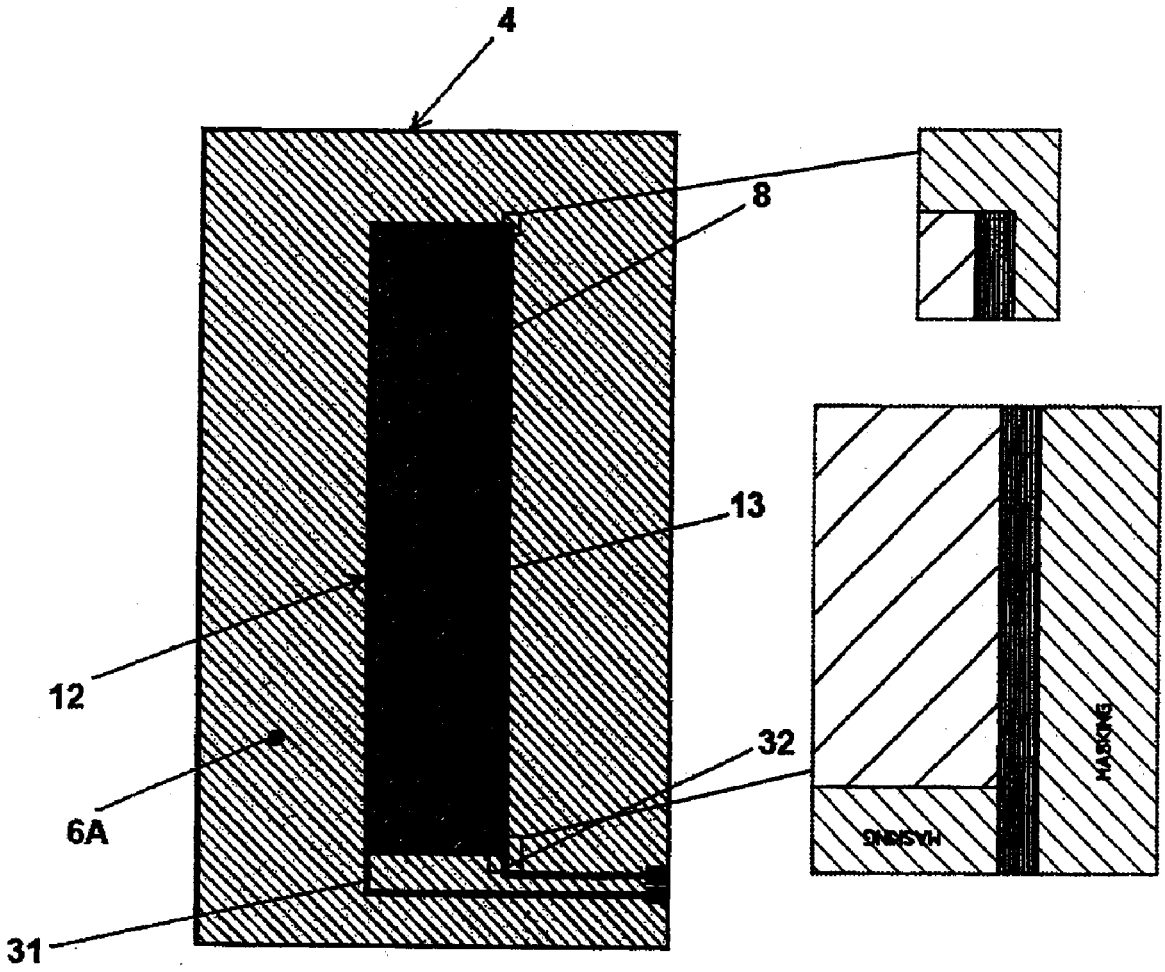
FIG. 4 is a plan symbolical view of a glass pane of the oven door according to the present invention, as viewed with some partial enlargements thereof.
Figure 5:
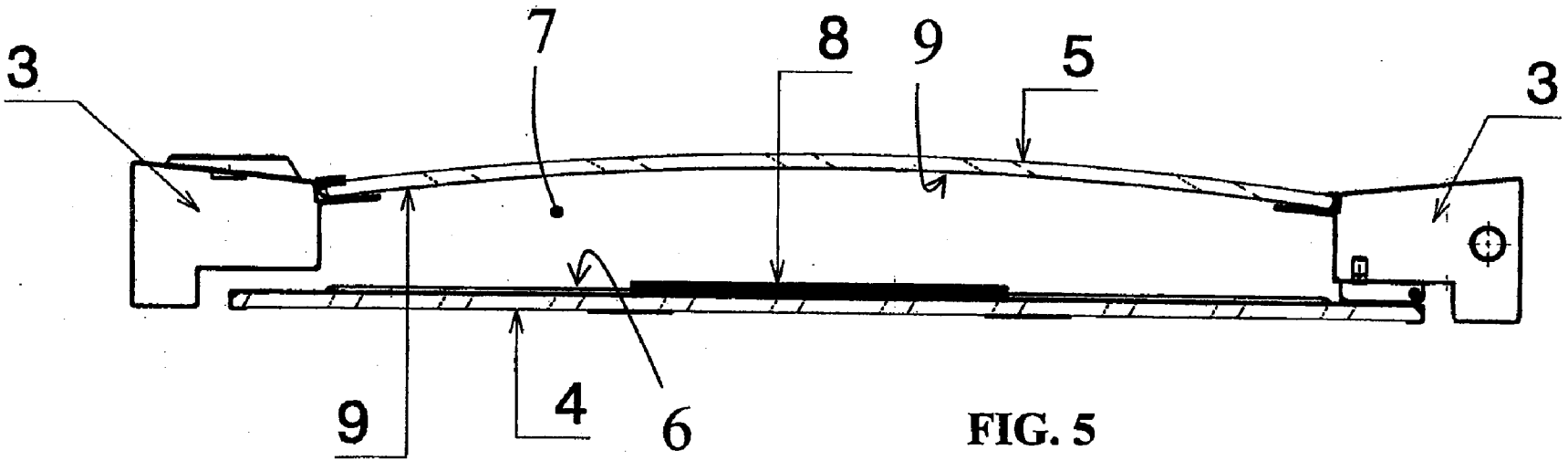
FIG. 5 is a simplified cross-sectional view of the door of the oven according to the present invention, as viewed across the section plane A-A of FIG. 1.

Said layer of resistive material shall not necessarily be applied to cover the entire surface 6 of the inner glass pane 4, but may rather be applied on just a defined portion thereof, namely onto and along a vertically extending strip, as this is best illustrated in FIGS. 4 and 5.

This is in fact effective in ensuring that the sole middle portion of the surface of the glass panes is kept free of condensate forming thereon, so as to facilitate viewing into the cooking cavity and watching the food being cooked there. This furthermore adds to the fact that, since in cooking ovens intended for commercial foodservice and mass-catering applications food is cooked in pans that are usually arranged one above each other on a number of tiers, ensuring good visibility into the cooking cavity all along a strip extending vertically enable the state of the food to be advantageously monitored in all such pans placed above each other over the entire height of the cooking cavity.

For such layer of resistive material 8 to be connected electrically to said power supply source, at the two opposite vertical edges of said layer of resistive material 8 there are advantageously provided two respective conductive members 12, 13 that substantially work as typical bus bars, which may be provided in the form of normal electric conductors and are of course in contact with the conductive material of the portion of layer 8 situated along said opposite edges thereof.

These conductive members 12, 13 are adapted to be connected to appropriate electric terminals (not shown) of the electric circuit of the oven with the aid of connecting means as generally known as such in the art, such as for instance simple electric conductors 31, 32. For reliability and safety reasons, however, it turns out as being particularly advantageous if the connection between said conductive members 12, 13 and the electric circuit included in the structure of the oven is comprised of automatic-release fit-in moving contacts, as they are generally known as such in the art, namely a first pair of automatic-release fit-in moving contacts 14A and 14B, which are provided on the inner edge of the frame 3 and the corresponding site on the outer portion 23 of the oven against which said frame 3 abuts when closing, respectively, for a first connection, and a second pair of automatic-release fit-in moving contacts 15A and 15B for a second, similarly made connection.

The advantage of automatic-release fit-in moving contacts derives also from the fact that, when the oven door is opened, they separate from each other, thereby opening, i.e. disconnecting the electric power-supply circuit and completely and safely isolating said layer 8 therefrom, so as to do away with any risk of said layer 8 and the related electric connections arranged on the door being kept energized, i.e. in a live condition when the door is open and, therefore, said connections and parts become exposed and accessible.

Figure 2:
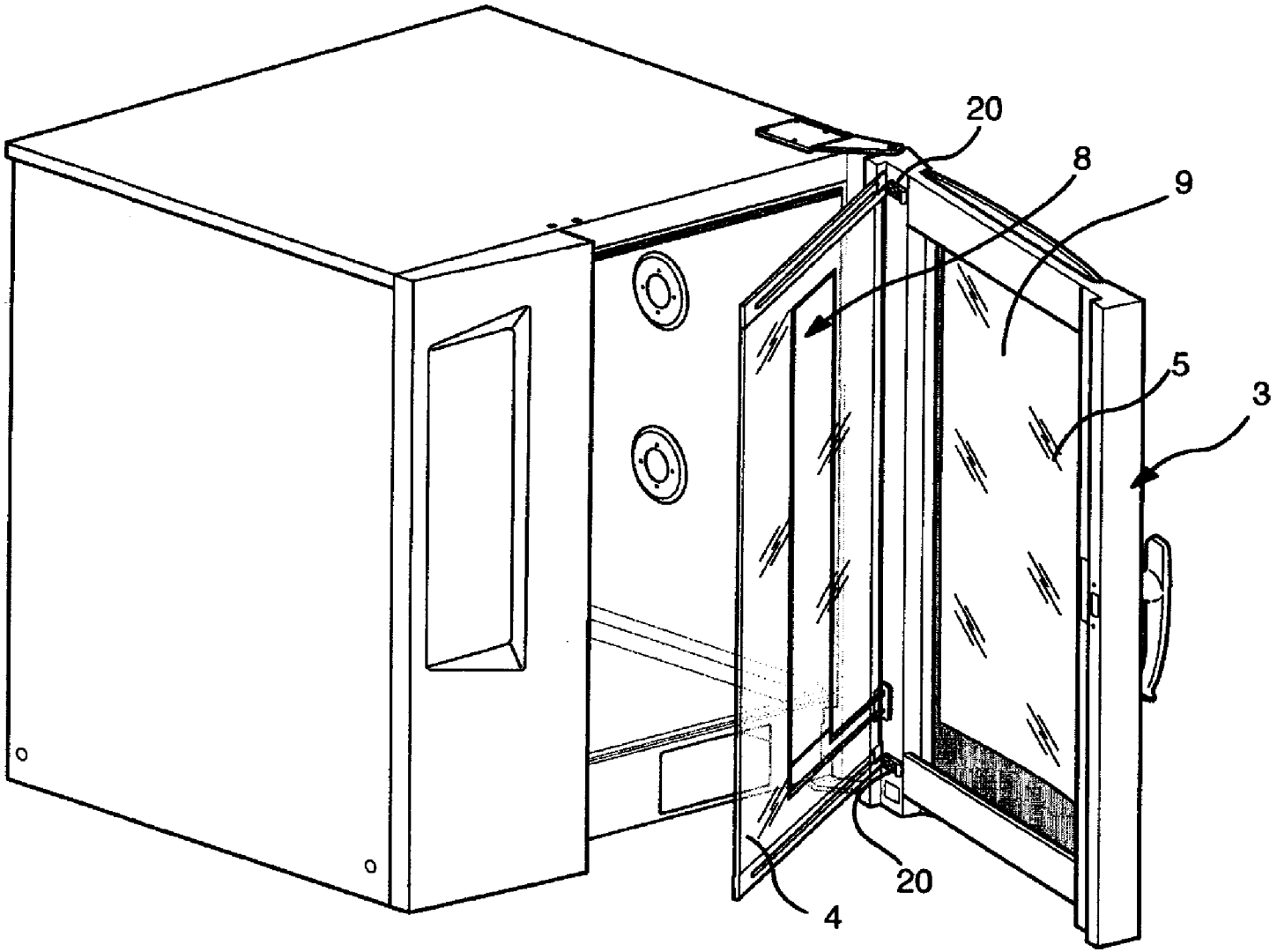
FIG. 2 is a perspective view of the oven shown in FIG. 1, wherein its door is in its open state, but the two glass panes thereof are partially spaced apart.
Figure 3:
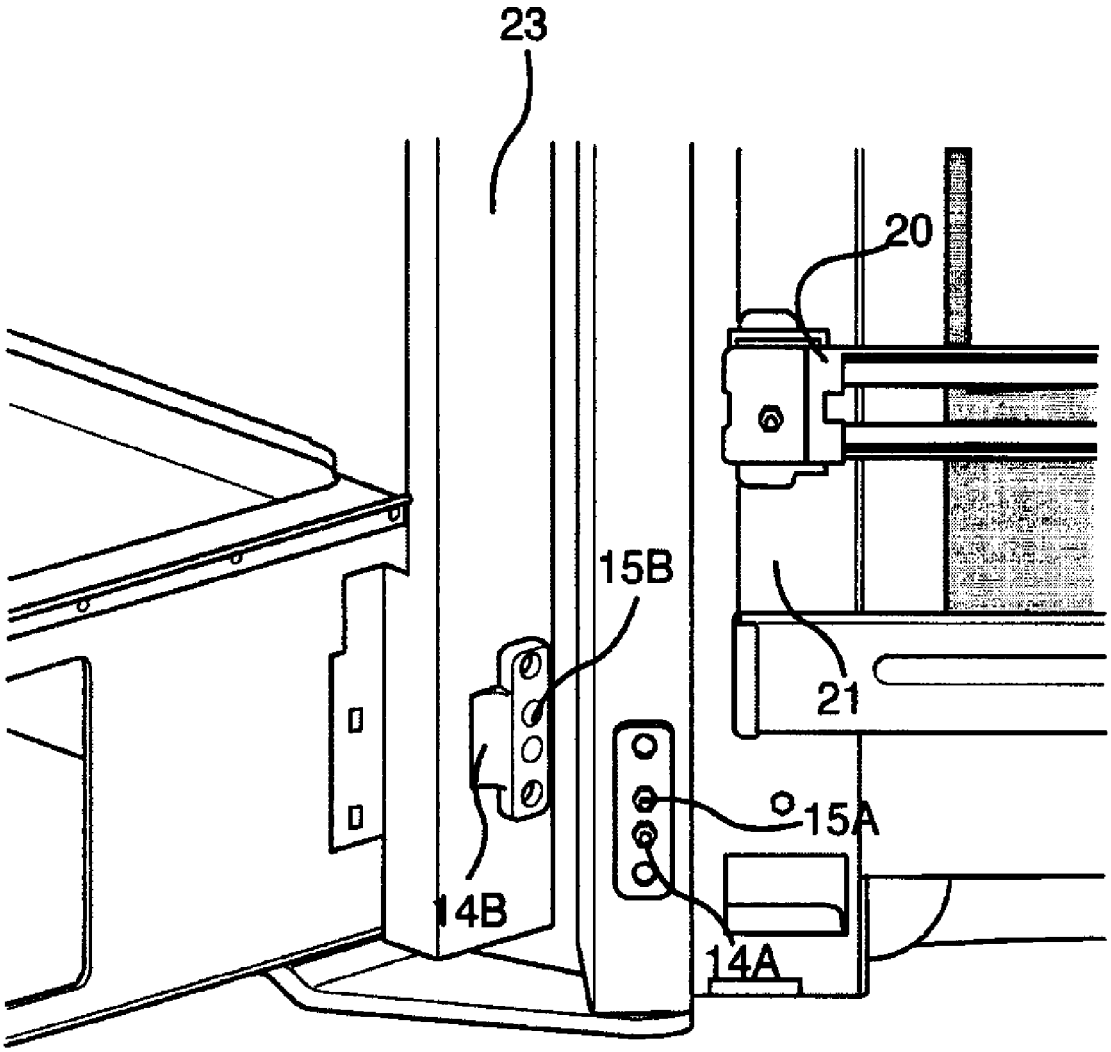
FIG. 3 is an enlarged view of a detail of FIG. 1.

With reference to FIGS. 1, 2 and 3, the inner glass pane 4 is designed to be partially removable from the working position thereof, in that it is namely hinged along the vertical outer edge 21 thereof—which extends contiguously to the vertical edge 22 of the frame 3 that is hinged on to the structure of the oven—by means of hinges 20 of a kind largely known as such in the art.

When the oven door is open, this solution enables said inner glass pane 4 to be opened and said hollow space 7 to be exposed for convenient accessibility in view of cleaning the glass surfaces, as this is regularly required, and/or performing regular maintenance.

As far as the above-mentioned layer of resistive material 8 is concerned, it may be advantageously comprised of stannous oxide; furthermore, it may be found on the market under the trade name of "C-50-Schott". It has been found that—at least as far as cooking ovens of the kind intended for commercial foodservice and mass-catering applications are concerned—the power input to said layer should be rated to result in a power density situated anywhere between 1500 and 2200 Ohm/m$^2$ and the resistance measured across said conductive members 12, 13 of said vertical strip of resistive layer 8 should be situated anywhere between 15 and 25 Ohm/m$^2$ for the condensate to be able to evaporate, while preventing the glass pane from heating up to any excessive extent.

In addition, for safety reasons—as generally required by safety standard regulations—the supply voltage used to energize said resistive layer 8 is most appropriately limited to max. 48 V.

For aesthetic reasons, i.e. for reasons of uniformity in both transparency and hue of the glass on which said resistive layer 8 has been applied, it may prove useful if even the remaining portion 6A of the surface 6 of the inner glass pane 4 is treated with the application of a similar layer of resistive material (see FIG. 4) that has however not to be electrically connected to any power source, so that it does by no means take part in the condensate removal process.

What is claimed is:

1. Cooking oven comprising:

a cooking cavity;

a door adapted to close said cooking cavity and provided with an outer frame;

one or more glass panes supported by said frame along the periphery thereof;

a first layer of substantially transparent resistive material provided on a first portion of the surface of at least one of said glass panes;

conductive members provided on the surface of at least one of said glass panes, wherein the first layer of substantially transparent resistive material is coupled to the conductive members such that the first portion is kept free of condensate forming thereon; and a second layer of resistive material provided on a second portion of the surface of at least one of the glass panes, wherein the second layer of resistive material is not electrically connected to any power source and is not capable of being electrically connected to any power source such that it does not take part in a condensate removal process and is not capable of taking part in the condensate removal process.

2. Cooking oven according to claim 1, wherein said first layer of resistive material is applied along a vertical strip extending centrally on the glass pane on which it is applied.

3. Cooking oven according to claim 1 or 2, wherein said first layer of resistive material has a surface resistance comprised between 15 and 25 Ohm/$m^2$.

4. Cooking oven according to claim 2, wherein at two opposite, preferably vertical edges of said vertical strip there are provided two respective conductive members or bus bars, each one of which is electrically connected to a respective one of said edges.

5. Cooking oven according to claim 1, wherein between the structure of said oven and said door there are provided electrically connecting means, and in that each one of said conductive members is electrically connected to a respective one of said electrically connecting means.

6. Cooking oven according to claim 5, wherein said electrically connecting means comprise two pairs of automatic-release fit-in moving connectors adapted to separate automatically whenever said door is opened.

7. Cooking oven according to claim 1, wherein said door is provided with two mutually opposing glass panes, an inner glass pane and an outer glass pane, extending parallel to each other at a definite distance from each other, so that a hollow space is defined therebetween, and in that said first layer of resistive material is applied on the surface of the inner glass pane that faces into said hollow space.

8. Cooking oven according to claim 7, wherein said inner glass pane is adapted to be selectively hinged on to said outer frame of the door, with the aid of hinging means between a vertical corner of said inner glass pane and a vertical edge of said outer frame, so as to be able to open out relative to said vertical edge of said outer frame.

9. Cooking oven according to claim 1, wherein said first layer of resistive material is prevailingly comprised of stannous oxide.

10. Cooking oven according to claim 1, wherein said oven is provided with power supply means adapted to energize said first layer of resistive material at a low voltage not exceeding 48 V.

11. Cooking oven according to claim 1, wherein the cooking oven is adapted to supply said first layer of resistive material with a power comprised between 1500 and 2200 W/$m^2$.

12. Cooking oven according to claim 1, wherein a remaining portion of the surface of the inner glass pane, which is not covered by said heating means, is coated with the second layer of resistive material that is of the same resistive material as said first layer of substantially transparent resistive material.

13. Cooking oven according to claim 1, wherein the cooking oven comprises electric conductors adapted to connect a lower region of the conductive members to the electric terminals.

14. Cooking oven according to claim 1, wherein the conductive members are positioned within the viewing area of at least one of the one or more glass panes.

15. Cooking oven according to claim 1, wherein the second layer of resistive material surrounds the first layer of resistive material.

* * * * *